US006509875B1

(12) United States Patent
Nair et al.

(10) Patent No.: US 6,509,875 B1
(45) Date of Patent: Jan. 21, 2003

(54) ELECTRONICALLY TUNED ACTIVE ANTENNA APPARATUS

(75) Inventors: Vijay K. Nair, Mesa, AZ (US); Samir El-Ghazaly, Chandler, AZ (US)

(73) Assignee: Motorola, Inc., Schaumburg, IL (US)

( * ) Notice: Subject to any disclaimer, the term of this patent is extended or adjusted under 35 U.S.C. 154(b) by 0 days.

(21) Appl. No.: 09/955,895

(22) Filed: Sep. 19, 2001

(51) Int. Cl.[7] ..... H01Q 1/38
(52) U.S. Cl. ..... 343/700 MS; 343/745
(58) Field of Search ..... 343/700 MS, 745

(56) References Cited

U.S. PATENT DOCUMENTS 4,780,724 A * 10/1988 Sharma et al. ..... 343/700 MS
5,394,159 A * 2/1995 Schneider et al. ... 343/700 MS
5,511,238 A * 4/1996 Bayraktaroglu ..... 343/700 MS
6,049,308 A * 4/2000 Hietala et al. ..... 343/700 MS
6,061,025 A * 5/2000 Jackson et al. ..... 343/700 MS
6,069,587 A * 5/2000 Lynch et al. ..... 343/700 MS
6,198,438 B1 * 3/2001 Herd et al. ..... 343/700 MS

* cited by examiner

*Primary Examiner*—Hoang Nguyen
(74) *Attorney, Agent, or Firm*—Douglas W. Gilmore; William E. Koch

(57) ABSTRACT

An electrically active antenna apparatus comprising a substrate, a RF feed positioned on the substrate, a radiator element positioned on the substrate and adjacent to the RF feed such that the radiator element and the RF feed are electromagnetically coupled, and a plurality of active devices that make electrical contact with the radiator element. The plurality of active devices are biased to actively tune the resonance frequency of the radiator element.

27 Claims, 6 Drawing Sheets

- PRIOR ART -

- PRIOR ART -

ELECTRONICALLY TUNED ACTIVE ANTENNA APPARATUS

FIELD OF THE INVENTION

This invention relates to antennas.

More particularly, the present invention relates to integrated antennas used in portable communication systems.

BACKGROUND OF THE INVENTION

An antenna is an essential element in most communication systems. This is particularly true for portable communication systems, such as cell phones, pagers, and laptop computers, where the size, weight, cost, and efficiency of the systems are critical design parameters. Types of antennas include monopole and dipole antennas, but these tend to be too large and obtrusive for the desired high operating frequencies, and, consequently, there is a need for elegant non-obtrusive antennas for portable communications systems.

FIG. 1 illustrates a plan view of an antenna 5 typically used in the prior art. Antenna 5 includes a voltage source 10 and a dipole antenna 20. Dipole antenna 20 has a length 25, a current distribution 30 and a radiation field pattern 40. For the antenna 5, most of the current is distributed within the middle section of the antenna and the ends do not radiate as effectively as the middle section. The two most important design parameters of antenna 5 is the electrical length, L, and the thickness parameter, t. The electrical length of a dipole antenna is given by $$L = \frac{\lambda ol}{\lambda},$$

where l is the physical length of the antenna element, λ is the resonant wavelength, and λo is the wavelength in free space. The thickness parameter of a dipole antenna is given by $$t = \frac{a}{l},$$

where 2*a* is the diameter or width of the dipole antenna.

FIG. 2 illustrates a capacitively loaded antenna 43. Since most of the current is closer to the center of antenna 5, it is possible to decrease the length of antenna 5 by capacitivly loading it without significantly distorting the current distribution. Capacitively loaded antenna 43 includes a voltage source 10 and a dipole antenna 50. Capacitively loaded dipole antenna 43 has a length 35, a current distribution 33, and a radiation field pattern 15. Further, the capacitive loading is provided by capacitors 45 which are electrically connected to dipole antenna 50. The result of the capacitive loading is to make length 35 less than length 25 while achieving the same resonance frequency. Also, current distribution 33 is more evenly distributed over the length of dipole antenna 50. A problem with capacitively loaded dipole antenna 43 is that the m resonance frequency is determined by length 35 and the values of capacitors 45. Once these parameters are set, the resonance frequency cannot be actively tuned.

A common type of antenna that is small and efficient for high frequency portable applications is the microstrip antenna. Microstrip antennas can be fabricated using inexpensive printed circuit board technology and can easily be integrated with other circuitry and electronic components. A patch antenna is a type of microstrip antenna that finds wide use in portable communication systems. However, most of the patch antennas in today's communication devices have very limited tuning capability and a relatively large physical size. Therefore, it is desirable to have a small electronically tunable antenna for use in portable communication systems.

It would be highly advantageous, therefore, to remedy the foregoing and other deficiencies inherent in the prior art.

Accordingly, it is an object of the present invention to provide a new and improved electronically active antenna apparatus.

It is an object of the present invention to provide a new and improved electronically active antenna apparatus which has a small size.

It is another object of the present invention to provide a new and improved electronically active antenna apparatus which has an improved radiation efficiency.

It is another object of the present invention to provide a new and improved electronically active antenna apparatus which can be tuned over a wide range of frequencies.

A further object of the invention is to provide a new and improved electronically active antenna apparatus which is inexpensive to manufacture.

SUMMARY OF THE INVENTION

To achieve the objects and advantages specified above and others, an electrically active antenna apparatus is disclosed which includes a substrate, a RF feed positioned on the substrate, a radiator element positioned on the substrate and adjacent to the RF feed such that the radiator element and the RF feed are electromagnetically coupled, and a plurality of active devices that make electrical contact with the radiator element.

The antenna is actively tuned by incorporating a varactor, a negative differential resistance device, a resonant tunneling device, or micro-electro-mechanical system (MEMS) component, or combinations of these devices in the plurality of active devices. The integration of a negative differential resistance device reduces the antenna resistance and improves the efficiency of radiation. The plurality of active devices changes the capacitive loading and, consequently, the resonant frequency of the active antenna. The capacitance and the resistance of an active device can be tuned by applying a DC bias. The MEMS devices allow loading of the antennas with low loss capacitors which minimizes the power loss and increases the efficiency of the antenna. The magnitude of operational DC voltage applied to the MEMS in general is larger than the magnitude of the RF signal that is fed to the antenna. Therefore the capacitance of the MEMS devices will not be modulated by the RF signal and hence the harmonic signal generation will be minimized. Further, the placement of the active devices in relation to the antenna affects the resonant frequency and tuning characteristics. Thus, the physical size of the active antenna can be decreased and the resonant frequency can be tuned without significantly decreasing the effective resonant length.

BRIEF DESCRIPTION OF THE DRAWINGS

The foregoing and further and more specific objects and advantages of the instant invention will become readily apparent to those skilled in the art from the following detailed description of a preferred embodiment thereof taken in conjunction with the following drawings.

DETAILED DESCRIPTION OF THE PREFERRED EMBODIMENT

Figure 1:
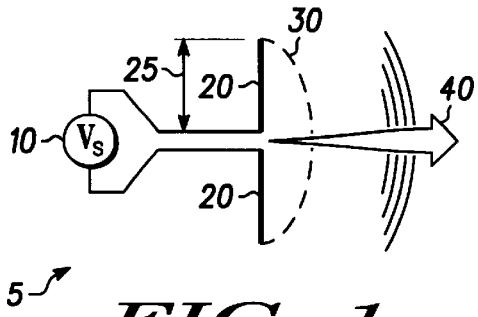
FIG. 1 is a plan view of a prior art dipole antenna.
Figure 2:
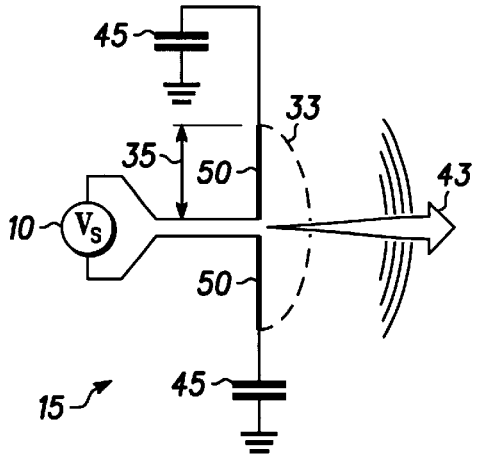
FIG. 2 is a plan view of a prior art dipole antenna that is capacitively loaded.
Figure 3:
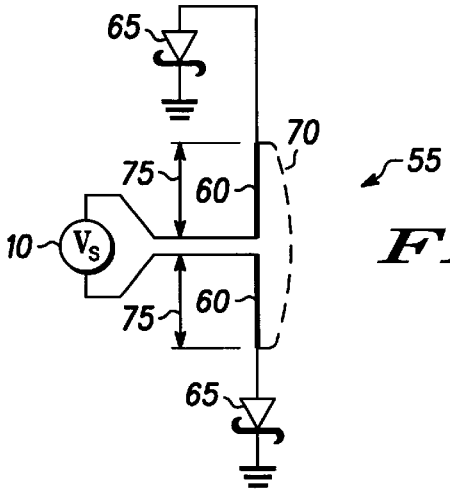
FIG. 3 is a plan view of a dipole antenna that is capacivitely loaded with a varactor diode that can be actively tuned.

Turn now to FIG. 3, which illustrates a simplified plan view of an actively tuned dipole antenna 55 in accordance with the present invention. The main purpose of this illustration is to demonstrate the basic idea behind actively tuning an antenna. Actively tuned dipole antenna 55 includes a dipole antenna 60 that has two ends each capacivitely loaded with a varactor diode 65, which has a diode capacitance that depends on the voltage bias across varactor diode 65. Actively tuned dipole antenna 55 further includes a voltage source 10. Dipole antenna 60 also has a physical length 75. Varactor diodes 65 are electrically connected to both ends of dipole antenna 60. A voltage bias can be applied to varactor diodes 65 to change its diode capacitance. The change in capacitance effectively changes the electrical length of the antenna without changing the physical length 75, and, consequently, actively tunes the resonance frequency of dipole antenna 60.

Figure 4:
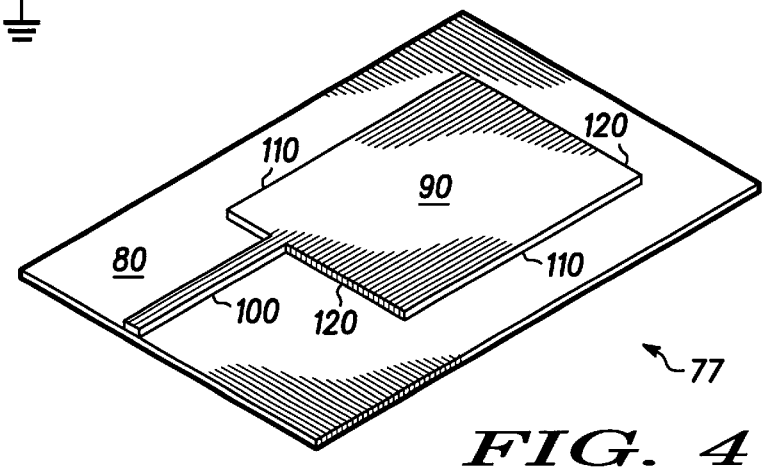
FIG. 4 is a plan view of a patch antenna.

Turn now to FIG. 4 which illustrates an isometric view of a simplified electrically active antenna apparatus 77 comprising, a substrate 80, a patch antenna 90, a plurality of active devices 140 (see FIG. 5), and a RF feed 100. Both patch antenna 90 and RF feed 100 are positioned on the substrate and are also positioned adjacent to each other such that they are electromagnetically coupled. The purpose of RF feed 100 is to allow an electromagnetic signal to travel to and from patch antenna 90. In this embodiment, RF feed 100 includes a microstrip line, but it will be understood that RF feed 100 could also include a capacitive coupler, a coaxial coupler, or any other type of electromagnetic coupler that allows an electromagnetic signal to travel back and forth to patch antenna 90.

In the preferred embodiment, electrically active antenna apparatus 77 includes a patch antenna which is commonly used in portable communication devices. It will be understood, however, that electrically active antenna apparatus 77 can include a number of other types of antennas, such as a dipole antenna, a monopole antenna, a microtrip antenna, or a slot antenna. Further, in the preferred embodiment, patch antenna 90 is rectangular in shape and has two sides with a physical length, designated 110, and two sides with a physical width, designated 120. Also patch antenna 90 has a resonance frequency and an area. It will be understood that patch antenna 90 can have various other shapes, but is chosen to be rectangular in this embodiment for illustrative purposes.

Figure 5:
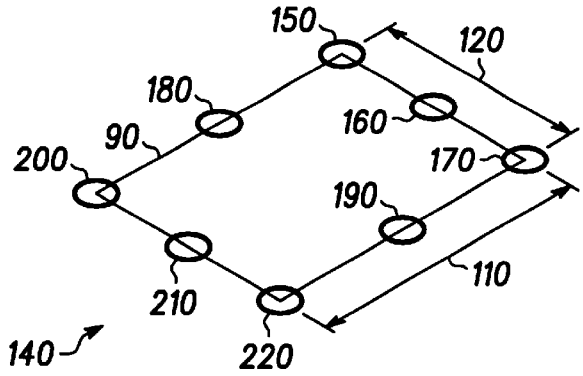
FIG. 5 is a plan view of a patch antenna showing the various positions for the plurality of active devices.
Figure 12:
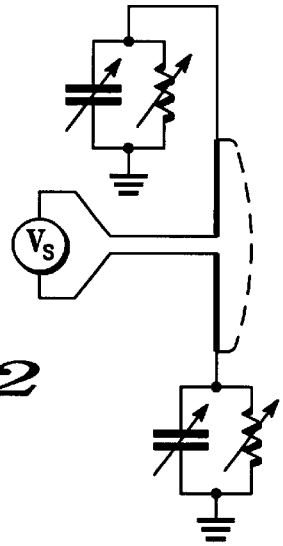
FIG. 12 is a plan view of a dipole antenna that is capacivitely and negative resistance loaded with a combination of a varactor diode and a negative resistance device that can be actively tuned.

Turn now to FIG. 5 which illustrates examples of the positioning of plurality of active devices 140 in relation to patch antenna 90. Plurality of active devices 140 are positioned such that they make electrical contact with patch antenna 90. Further, in the preferred embodiment, plurality of active devices 140 are positioned on substrate 80 (not shown). The plurality of active devices can include a varactor, a negative differential resistance device, a resonant tunneling diode, MEMS device, or any other type of device or apparatus that can be used to actively tune the resonance frequency of radiator element 90. As an example, refer to FIG. 12 which illustrates an actively tuned dipole antenna with a combination of tunable devices, such as a veractor and a negative differential resistance device (many other active devices, such as MEMS can be included) positioned at each end. The negative differential resistance device includes a variable capacitor in parallel with a negative resistor or a resonant tunneling device that exhibits negative differential resistance. One advantage of the embodiment shown in FIG. 12 is that the radiation efficiency is improved due to the presence of the negative resistor. Plurality of active devices 140 changes the capacitive loading and, consequently, the resonant frequency of patch antenna 90. The resistance and capacitance of plurality of active devices 140 can be changed by adjusting a DC bias.

To illustrate the tuning capability of electrically active antenna apparatus 77, modeling of the directivity and radiation pattern, as well as the change in area and resonance frequency of the patch antenna, were performed with active devices in the following patterns in relation to patch antenna 90 of FIG. 5. Modeling of the antenna and the attached devices was achieved using the Finite-Difference Time-Domain(FDTD) technique [K. S. Yee, "Numerical Solution of Initial Boundary Value Problems Involving Maxwell's Equations in Isotropic Media," IEEE Transactions on Antenna and propagation, Vol AP-14,pp. 302–307, 1966]. The software was then specifically developed to model the antenna 90 of FIG. 5. For the first embodiment, active devices were placed in position 180 and position 190. For another embodiment, active devices were placed in positions 200 and 220. Further, more modeling work was performed with active devices in positions 150 and 220. Finally yet another embodiment was modeled with active devices in positions 150, 170, 200, and 220. For reference, modeling work was also performed without any active devices present.

It will be understood that the plurality of active devices 140 can be positioned in other patterns, but the patterns shown here are chosen for illustrative purposes. For example, positions 160 and 210 could be used or even intermediate positions along length 110 and width 120. However, the combination of positions mentioned previously is chosen to illustrate the active tuning of electrically active antenna apparatus 77. Some of the results are shown in the following table and are illustrated graphically in FIG. 6. In the table, the equivalent antenna length and width refer to the dimensions of an antenna that would be needed to achieve the resonance frequency f, without the use of the plurality of active devices 140.

| Position | Actual Length (mm) | Actual Width (mm) | Equiv. Antenna Length (mm) | Equiv. Antenna Width (mm) | f GHz | Percent Change f | Percent Change Area |
|---|---|---|---|---|---|---|---|
| None | 16 | 12.45 | 16 | 12.45 | 7.57 | 0 | 0 |
| 180–190 | 16 | 12.45 | 16 | 15.6 | 6.07 | 20 | 20 |
| 200–220 | 16 | 12.45 | 24 | 12.45 | 4.18 | 45 | 33 |
| 150–220 | 16 | 12.45 | 28 | 12.45 | 3.88 | 49 | 43 |
| 150–170–200–220 | 16 | 12.45 | 30 | 12.45 | 3.38 | 55 | 47 |

Figure 6:
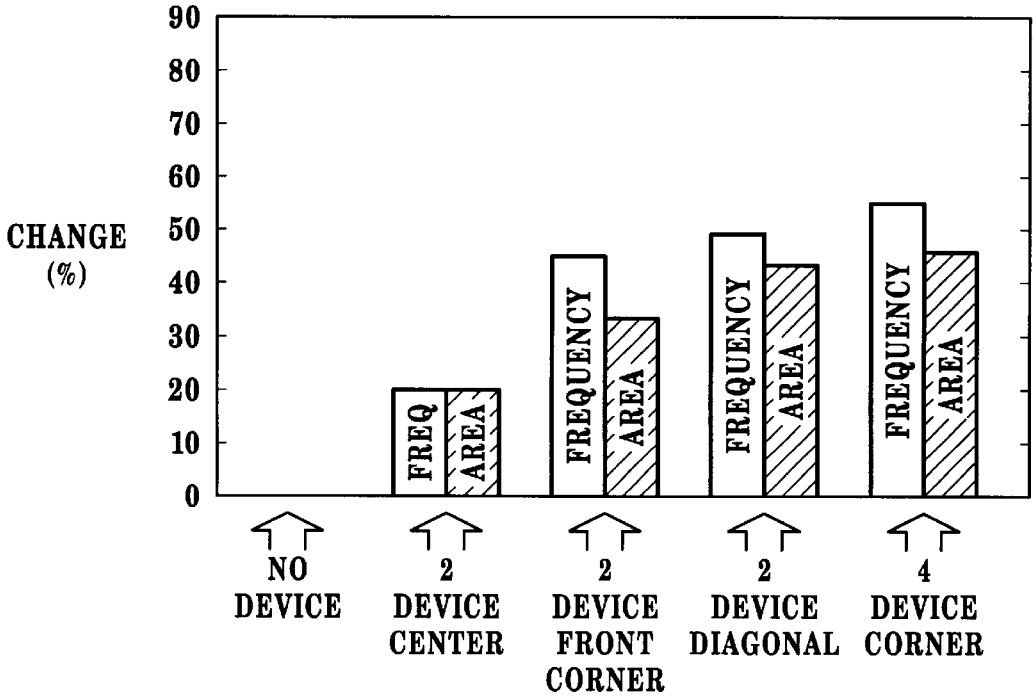
FIG. 6 is a bar chart showing the percent frequency change and the percent antenna area change of the active antenna.

In the preferred embodiment, physical length 110 is chosen to be 16 mm and physical width 120 is chosen to be 12.45 mm. These are the physical values for patch antenna 90 without active tuning (no active devices are present) where the resonance frequency is approximately 7.47 GHz. For a specific example of active tuning, consider active devices in positions 150, 170, 200, and 220. When the active devices are biased to have a capacitance of 1 pF, the resonance frequency of patch antenna 90 changes by approximately 55 percent (from 7.47 GHz to 3.38 GHz) and the physical area of patch antenna 90 changes by approximately 47 percent (from 373.5 $mm^2$ to 199.2 $mm^2$), as graphically illustrated in FIG. 6. This result means that a patch antenna with a length of 16 mm and a width of 12.45 mm with active devices positioned and biased as discussed previously will have the same resonance frequency as a patch antenna with a length of 30 mm and a width of 12.45 mm. Similar results are obtained for the other patterns described previously. The results from the table and FIG. 6 show that the resonant frequency as well as electrical length and electrical width of patch antenna 90 can be varied without changing the physical length 110 and physical width 120 by the placement and biasing of plurality of active devices 140. Also, the dimensions of patch antenna 90 can be significantly reduced without changing the resonance frequency.

Figure 7:
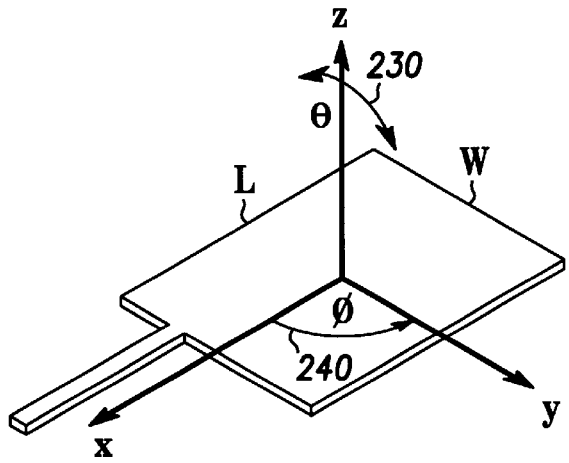
FIG. 7 is a directivity plot of a patch antenna with four corner diodes.
Figure 7:
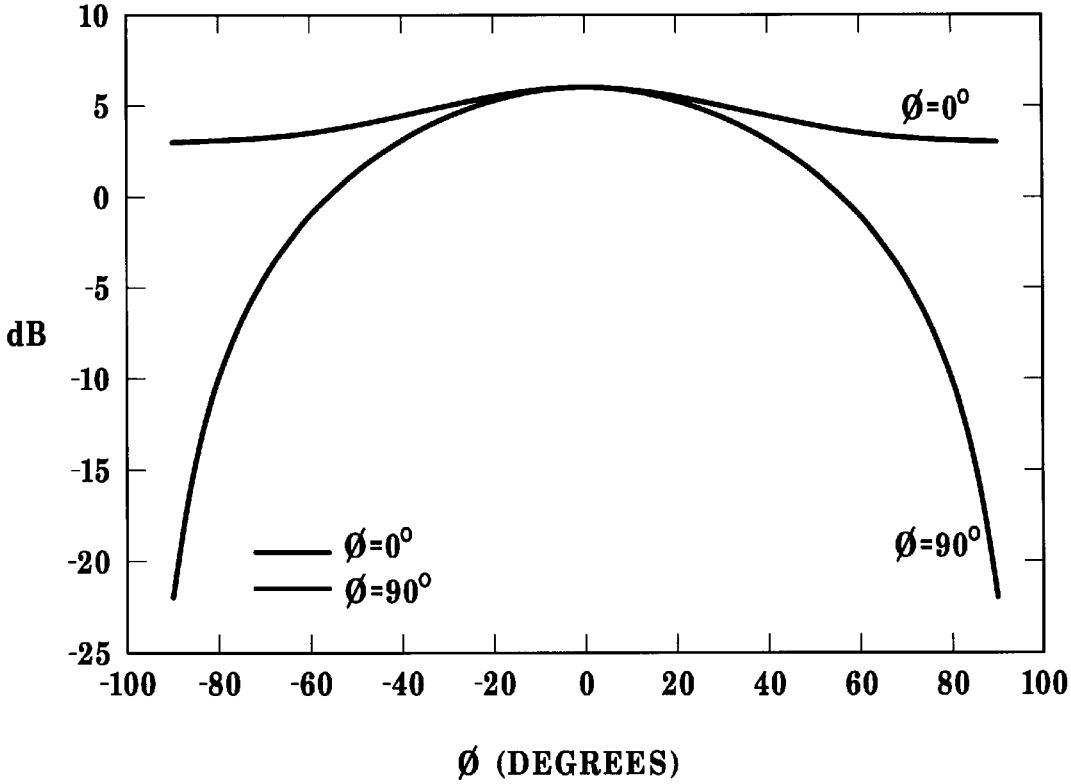

To further elaborate on this example, turn to FIG. 7 which illustrates the directivity of patch antenna 90 with plurality of active devices 140 placed in positions 150, 170, 200, and 220. The angle $\theta$ and the angle $\phi$ are defined as indicated by directions 230 and 240, respectively, as shown. FIG. 7 shows the directivity when $\phi=0°$ and $\phi=90°$ as a function of $\theta$ when the active devices are biased so that their capacitance is 1 pF. The resonance frequency under these biasing conditions is 3.38 GHz, which is a 55 percent change, as discussed previously. As can be seen in FIG. 7, the directivity is broad when $\phi=0°$, indicating that the current is more evenly distributed along electrical length 110.

Figure 8:
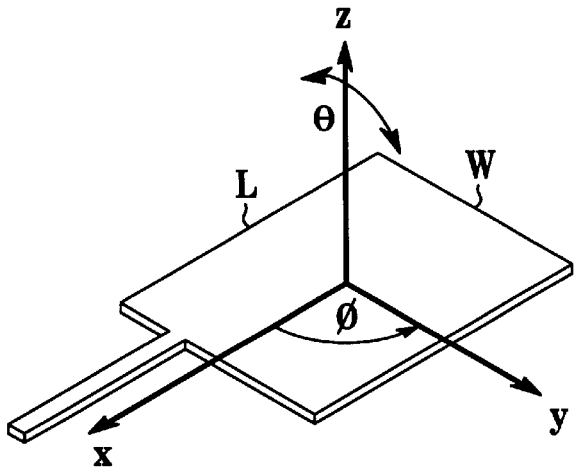
FIG. 8 is a directivity plot of an equivalent patch antenna.
Figure 8:
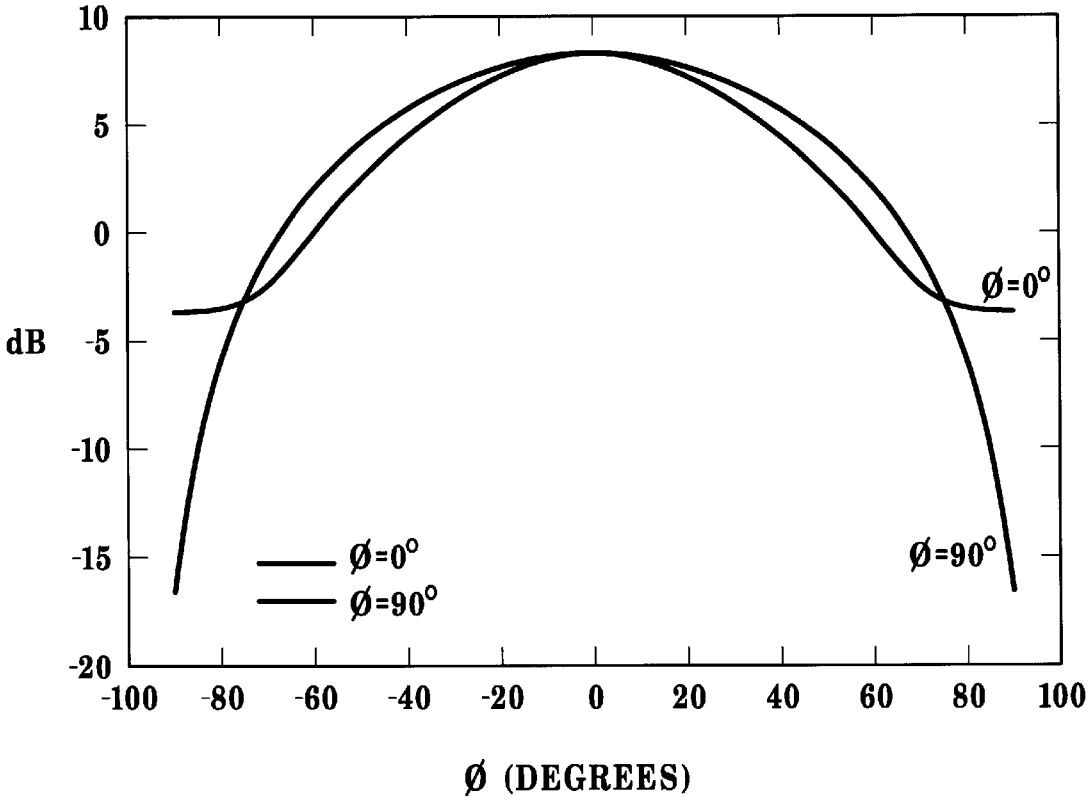

Turn now to FIG. 8 which illustrates the directivity of an equivalent patch antenna without active devices where physical length 110 is 30 mm and physical width 120 is 12.45 mm. In this case, the directivity is narrower than in FIG. 7, indicating that the current is distributed towards the center of patch antenna 90. This is especially apparent for when $\phi=0°$. Thus, the presence of plurality of active devices 140 changes the directivity pattern of patch antenna 90 by more evenly distributing the current 70 and also decreases physical length 110 and physical width 120.

Figure 9:
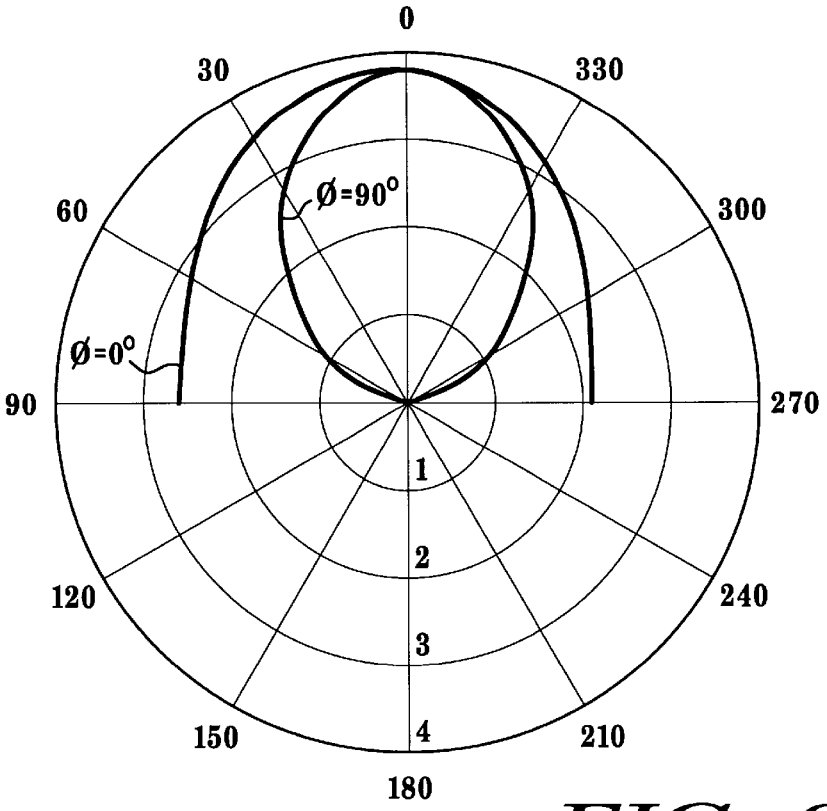
FIG. 9 is a radiation pattern of a patch antenna is with four corner diodes.

Turn now to FIG. 9 which illustrates the radiation pattern for patch antenna 90 as described in FIG. 7. The radiation pattern for $\phi=0°$ is nonzero when $\theta=90°$ and $\theta=270°$.

Figure 10:
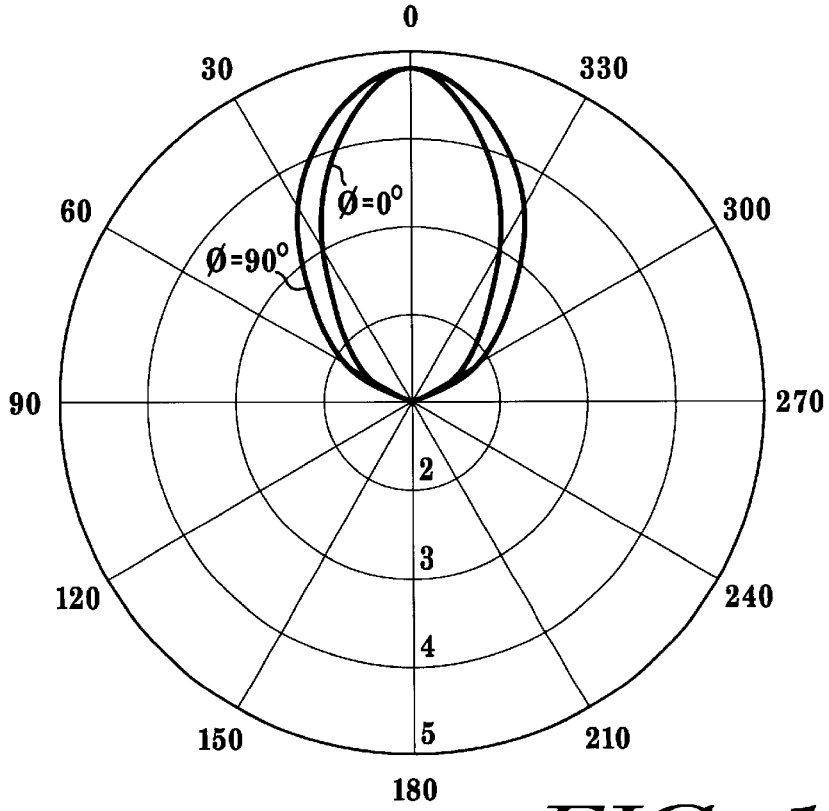
FIG. 10 is a radiation pattern of an equivalent patch antenna.

This result again illustrates that the current is distributed more evenly in patch antenna 90. This can also be seen when comparing the radiation pattern of FIG. 9 with the radiation pattern of FIG. 10 which is for the patch antenna described in FIG. 8.

Figure 11:
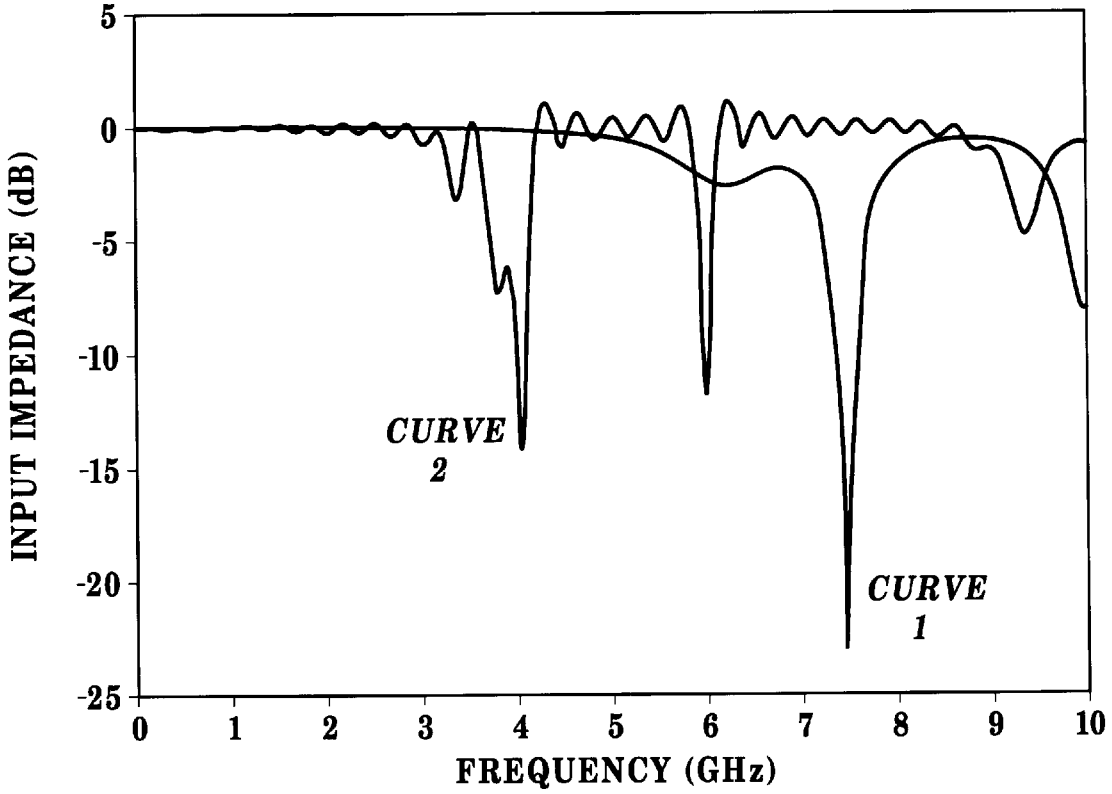
FIG. 11 is an antenna impedance plot of a patch antenna with four corner diodes.

The main point is that a voltage bias can be applied to the plurality of active devices 140 in the various patterns described previously to change electrical length and electrical width of patch antenna 90 without changing the physical length 110 and physical width 120, and, consequently, actively tune the resonance frequency of patch antenna 90. This is clearly demonstrated in FIG. 11 which illustrates an antenna impedance plot of patch antenna 90 with four corner diodes. From the impedance plot, the resonance frequency with no diode attached (C=0 pF) is at 7.47 GHz (see Curve 1). When plurality of active devices 140 are biased such that each diode has a capacitance of 1 pF, the resonance frequency is shifted to 3.38 GHz (see curve 2). An equivalent patch antenna for 3.38 GHz without the diodes would have a physical length of 30 mm and physical width of 12.5 mm. Thus, the physical size of the active antenna can be decreased and the resonant frequency can be tuned over a wide range of frequencies without significantly decreasing the effective resonant length. Also, the radiation efficiency of electrically active antenna apparatus 77 can be improved by more evenly distributing the current over the area of the antenna.

Various changes and modifications to the embodiments herein chosen for purposes of illustration will readily occur to those skilled in the art. To the extent that such modifications and variations do not depart from the spirit of the invention, they are intended to be included within the scope thereof which is assessed only by a fair interpretation of the following claims.

Having fully described the invention in such clear and concise terms as to enable those skilled in the art to understand and practice the same, the invention claimed is:

1. An electrically active antenna apparatus having a modifiable operational frequency as a function of radiative element form factor and positional location of active device elements with respect to at least one radiative element, comprising:

a substrate;

a RF feed positioned on the substrate;

a radiator element positioned on the substrate and adjacent to the RF feed such that the radiator element and the RF feed are electromagnetically coupled; and at least one of said active elements positioned on at least one corner of a patch antenna, wherein said active device makes peripheral electrical contact with the radiator element.

2. An electrically active antenna apparatus as claimed in claim 1 further including a plurality of active devices that make electrical contact with the radiator element.

3. An electrically active antenna apparatus as claimed in claim 2 wherein the plurality of active devices include a varactor.

4. An electrically active antenna apparatus as claimed in claim 2 wherein the plurality of active devices include a negative differential resistance device.

5. An electrically active antenna apparatus as claimed in claim 2 wherein the plurality of active elements include a resonant tunneling diode.

6. An electrically active antenna apparatus as claimed in claim 2 wherein the plurality of active elements includes a MEMS device.

7. An electrically active antenna apparatus as claimed in claim 1 wherein the radiator element is one of a dipole antenna, a monopole antenna, a microtrip antenna, a slot antenna, and a patch antenna.

8. An electrically active antenna apparatus as claimed in claim 1 wherein the RF feed is electromagnetically coupled with the radiator element so that an electromagnetic signal can travel to and from the radiator element.

9. An electrically active antenna apparatus as claimed in claim 8, wherein the RF feed is electromagnetically coupled to the radiator element by using one of a capacitive coupler, a coaxial coupler, and a microstrip.

10. An electrically active antenna apparatus having a modifiable operational frequency as a function of radiative element form factor and positional location of active device elements with respect to at least one radiative element, comprising:

a substrate;

a RF feed positioned on the substrate;

a patch antenna with a width and a length positioned on the substrate and adjacent to the RF feed such that the patch antenna and the RF feed are electromagnetically coupled; and at least one of said active elements positioned on at least one corner of the patch antenna, wherein said plurality of active devices make peripheral electrical contact with the patch antenna.

11. An electrically active antenna apparatus as claimed in claim 10 wherein the patch antenna has a plurality of corners and a plurality of edges.

12. An electrically active antenna apparatus as claimed in claim 11 wherein the RF feed is electromagnetically coupled to the radiator element by using one of a capacitive coupler, a coaxial coupler, and a microstrip.

13. An electrically active antenna apparatus as claimed in claim 10 wherein the RF feed is electromagnetically coupled with the radiator element so that an electromagnetic signal can travel to and from the radiator element.

14. An electrically active antenna apparatus as claimed in claim 10 wherein the plurality of active elements has at least one active element positioned on at least one edge of the patch antenna.

15. An electrically active antenna apparatus as claimed in claim 10 wherein the plurality of active elements include a varactor.

16. An electrically active antenna apparatus as claimed in claim 10 wherein the plurality of active elements include a negative differential resistance device.

17. An electrically active antenna apparatus as claimed in claim 10 wherein the plurality of active elements Include a MEMS device.

18. An electrically active antenna apparatus as claimed in claim 10 wherein the plurality of active elements include a resonant tunneling diode.

19. A method of forming an electrically tunable active antenna apparatus having a modifiable operational frequency as a function of radiative element form factor and positional location of active device elements with respect to at least one radiative element, comprising the steps of:

providing a substrate;

forming a RF feed positioned on the substrate;

forming a patch antenna with a resonant frequency positioned on the substrate and adjacent to the RF feed such that the patch antenna and the RF feed are electromagnetically coupled;

forming a plurality of active devices that make peripheral electrical contact with the patch antenna, wherein at least one of said active elements is positioned on at least one corner of the patch antenna; and applying a voltage bias to the plurality of active devices to actively tune the resonant frequency of the patch antenna.

20. A method of forming an electrically tunable active antenna apparatus as claimed in claim 19 wherein the patch antenna is rectangular in shape.

21. A method of forming an electrically tunable active antenna apparatus as claimed in claim 19 wherein the RF feed is electromagnetically coupled with the radiator element so that an electromagnetic signal can travel to and from the radiator element.

22. A method of forming an electrically tunable active antenna apparatus as claimed in claim 19 wherein the plurality of active elements has at least one active element positioned on at least one edge of the patch antenna.

23. A method of forming an electrically tunable active antenna apparatus as claimed in claim 19 wherein the plurality of active elements include a device or apparatus that can actively change the resonance frequency of the patch antenna.

24. A method of forming an electrically tunable active antenna apparatus as claimed in claim 19 wherein the plurality of active elements include a varactor.

25. A method of forming a electrically tunable active antenna apparatus as claimed in claim 19 wherein the plurality of active elements Include a negative differential resistance device.

26. A method of forming electrically tunable active antenna apparatus as claimed in claim 19 wherein the plurality of active elements include a resonant tunneling diode.

27. A method of forming an electrically tunable active antenna apparatus as claimed in claim 19 wherein the plurality of active elements include a MEMS device.

* * * * *